US005829963A

United States Patent [19]

Ichikawa

[11] Patent Number: 5,829,963

[45] Date of Patent: Nov. 3, 1998

[54] GAS LIGHTER WITH SAFETY DEVICE

[75] Inventor: Makoto Ichikawa, Tokyo, Japan

[73] Assignee: Modern Royal Co., Ltd., Tokyo, Japan

[21] Appl. No.: 657,564

[22] Filed: Jun. 4, 1996

[51] Int. Cl.[6] ..... F24D 11/36

[52] U.S. Cl. ..... 431/153; 431/255; 431/276; 431/277; 431/254

[58] Field of Search ..... 431/153, 255, 431/276, 277, 254

[56] References Cited

U.S. PATENT DOCUMENTS

| | | | |
|---|---|---|---|
| D. 359,818 | 6/1995 | Ichikawa . | |
| D. 360,052 | 7/1995 | Ichikawa . | |
| D. 368,980 | 4/1996 | Ichikawa . | |
| 5,120,215 | 6/1992 | Amoros Nollas . | |
| 5,145,358 | 9/1992 | Shike et al. | 431/153 |
| 5,409,372 | 4/1995 | Nobuo . | |
| 5,445,520 | 8/1995 | Ichikawa . | |
| 5,451,159 | 9/1995 | Kim | 431/153 |
| 5,538,417 | 7/1996 | Chan | 431/153 |

*Primary Examiner*—Larry Jones
*Attorney, Agent, or Firm*—Oblon, Spivak, McClelland, Maier & Neustadt, P.C.

[57] ABSTRACT

A gas lighter having a safety device includes a lighter body that includes a fuel emission portion for emitting fuel from a fuel well, a piezoelectric unit having an ignition pushbutton and a shoulder portion, and a cutaway portion on a top part of the body. A cap is arranged on the cutaway portion such that the cap can be depressed to depress the ignition pushbutton. A lock member positioned between the cap and ignition pushbutton, over the ignition pushbutton, includes a resilient leg at one end and a rigid leg at another end. An end of the rigid leg urged into a position over the shoulder portion of the piezoelectric unit by the resilient leg, is moved from this position over the shoulder portion to a position away from the piezoelectric unit by operating the lock member against the urging force of the resilient leg.

4 Claims, 6 Drawing Sheets

GAS LIGHTER WITH SAFETY DEVICE

BACKGROUND OF THE INVENTION

1. Field of the Invention

This invention relates to a gas lighter having a child-proof safety device that prevents the ignition actuating lever from being depressed when the lighter is not being used.

2. Description of the Prior Art

Gas lighters are convenient devices that can be readily operated simply by pressing an ignition actuating lever or pushbutton. At the same time, this also means that there is a risk that a child playing with a lighter might press down on the ignition lever and thereby light the lighter, causing the child to suffer burns and possibly starting a fire. Even a lighter being carried in someone's pocket can be accidentally ignited by the ignition lever being pressed if the person should trip and fall, or even just hit against some object. In such a case, the lighter could ignite the clothing, causing the person to suffer burns.

To prevent this type of inadvertent or unintentional ignition, various types of gas lighters have been proposed that include safety mechanisms to lock the ignition lever so that the ignition lever cannot be depressed.

U.S. Pat. No. 5,120,215, for example, discloses a gas lighter with a locking mechanism comprising a safety lever having resilient legs at the lower end and a tongue at the upper end that projects out from an L-shaped window in the body of the lighter. Under the urging of the resilient legs, the safety lever normally occupies a position in the L-shaped window with the tongue at the end of the horizontal leg of the window. In that position, the pushbutton and the upper edge of the safety lever are in abutment, preventing operation of the lighter. To light the lighter, a finger is used to push the tongue across and up to the other end of the L-shaped window, in which position the tongue is in alignment with a recess provided in the lower part of the pushbutton, such that the pushbutton can be depressed to ignite the lighter, and the tongue stays in that position even when no longer being manually pressed. After lighting is accomplished and the pushbutton is released, the force of the legs moves the tongue back to the safety position in the horizontal part of the L-shaped window, again preventing the pushbutton from being depressed.

U.S. Pat. No. 5,409,372 discloses a gas lighter with a safety device having a lock member in the shape of an inverted U that can be pivoted below one end of the ignition lever. The lower side of the ignition lever has a recess, and the part of the lighter body below the ignition lever is provided with a rectangular opening. The lock member is normally maintained in a horizontal position with the ends in abutment beside the opening in the lighter body, thereby preventing depression of the actuating ignition lever. To use the lighter, a finger is used to depress an operating portion of the lock member. This pivots the lock member, whereby the upper part at the other end is moved up into the recess in the underside of the ignition lever and the leg of the lock member at the pivot end moves into the rectangular opening in the lighter body. An engagement of engaging portions maintains the lock member in this released position. The lighter can be operated with the lock member in this position, since the location of the leg of the lock member in the rectangular opening enables the ignition lever to be depressed. This depression of the ignition lever also disengages the engaging portions, so that when the operating finger is removed from the ignition lever, the ignition lever can pivot back into the horizontal position, again preventing the depression of the ignition lever.

U.S. Pat. No. 5,655,901 discloses a gas lighter with a lock member comprising inner and outer plates and a sliding piece urged to an end of a slot that broadens out toward the upper end of the slot. When the lighter is not in use, constant abutment between the lower end of an ignition pushbutton and the inner plate of the sliding piece prevents the button being pushed down to light the lighter. The lower end of the ignition pushbutton has a slit. To use the lighter, the user pushes the sliding piece to turn it to the other side of the slit and position the inner plate at the lower part of the pushbutton slit. The inner plate is pushed further upward so that it locates in the slit, where it stays even when the finger is removed. In this position, the lighter can be operated by depressing the pushbutton. At the same time, this disengages the inner plate from the slit, so that when the finger is removed, the inner plate is urged back to its original position in abutment with the pushbutton, thus preventing depression of the pushbutton.

In each of these conventional gas lighters with a safety device, the locking mechanism is relatively simple. To operate the lighter, a finger is used to release a lock member disposed on the lighter body, and the same finger is then used to depress a button or lever to ignite the lighter. However, people who make frequent use of lighters find it troublesome to have to change their grip to light the lighter after releasing the lock member. Moreover, having the locking member projecting from the body of the lighter makes the lighter awkward to handle and can lead to misoperation and/or breakage of the lighter.

An object of the present invention is to provide a gas lighter with a safety device that enables the safety lock to be released and the lighter ignited without having to change finger position.

Another object of the present invention is to provide a gas lighter with a safety device in which the exterior aspect of the lighter is not marred or changed by the appearance of a lock member.

SUMMARY OF THE INVENTION

To attain the above object, the present invention provides a gas lighter with a safety device, comprising a lighter body that includes a fuel emission portion for emitting fuel from a fuel well, a piezoelectric unit having an ignition pushbutton and a shoulder portion, and a cutaway portion on a top part of the body;

a cap on the cutaway portion that can be depressed into the cutaway portion to depress the ignition pushbutton;

a lock member located between the cap and ignition pushbutton that straddles the ignition pushbutton, said lock member including a resilient leg at one end and a rigid leg at another end, in which an end of the rigid leg urged into a position over the shoulder portion of the piezoelectric unit by the resilient leg is moved from its position over the shoulder portion to a position away from the piezoelectric unit by operating the lock member against the urging force of the resilient leg.

With the lighter thus configured according to this invention, depression of the cap is prevented by the abutment of the rigid leg of the lock member against the shoulder portion of the piezoelectric unit, thus preventing lighter ignition taking place.

To operate the lighter, a finger is used to slide the grip or cap forward or backward to move the end of the rigid leg from its position over the shoulder portion of the piezoelectric. Without any change in finger position, the finger is then used to depress the cap, thereby depressing the ignition button, which activates the piezoelectric unit and lights the lighter.

As described above, the gas lighter of this invention is readily operated by using a finger to slide the cap in the required direction and then depress the cap. This makes the lighter easier and more convenient to use than conventional gas lighter safety devices which require that the safety lock first be released, after which the user must adjust his or her hold to light the lighter. Further safety can be ensured by adjusting such factors as the thickness and length of the resilient leg of the lock member to increase the force needed to move the cap or grip to thereby make the lighter as child-proof as required. Furthermore, since it is not necessary to provide a lock member on the outside of the lighter, the lighter looks as good as an ordinary lighter with no safety device, and is even less likely to be operated by mistake or suffer damage.

Further features of the invention, its nature and various advantages will be more apparent from the accompanying drawings and following detailed description of the invention.

DESCRIPTION OF THE PREFERRED EMBODIMENT

Figure 1:
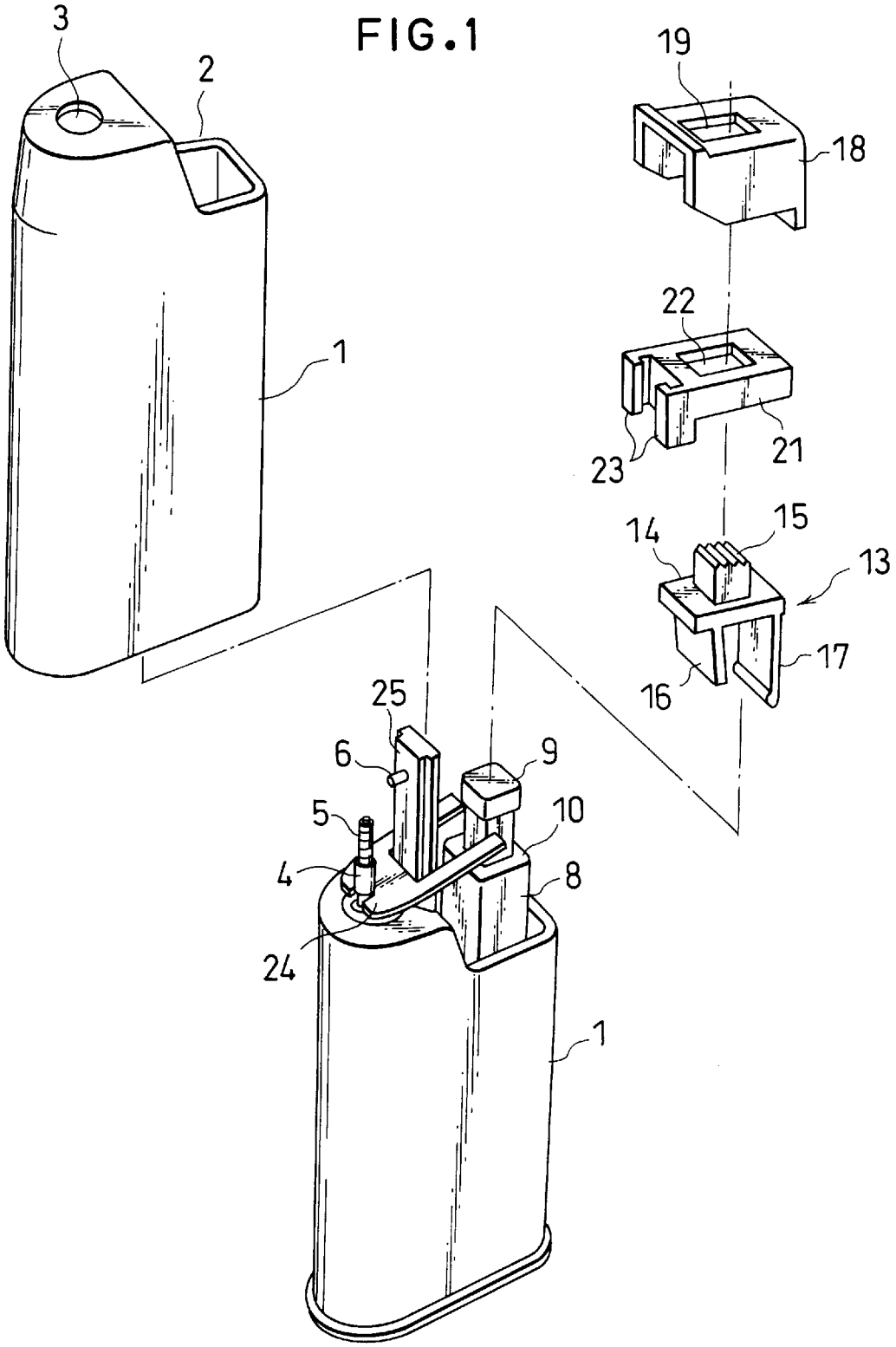
FIG. 1 is a disassembled perspective view of a first embodiment of the gas lighter with safety device according to the present invention.
Figure 2:
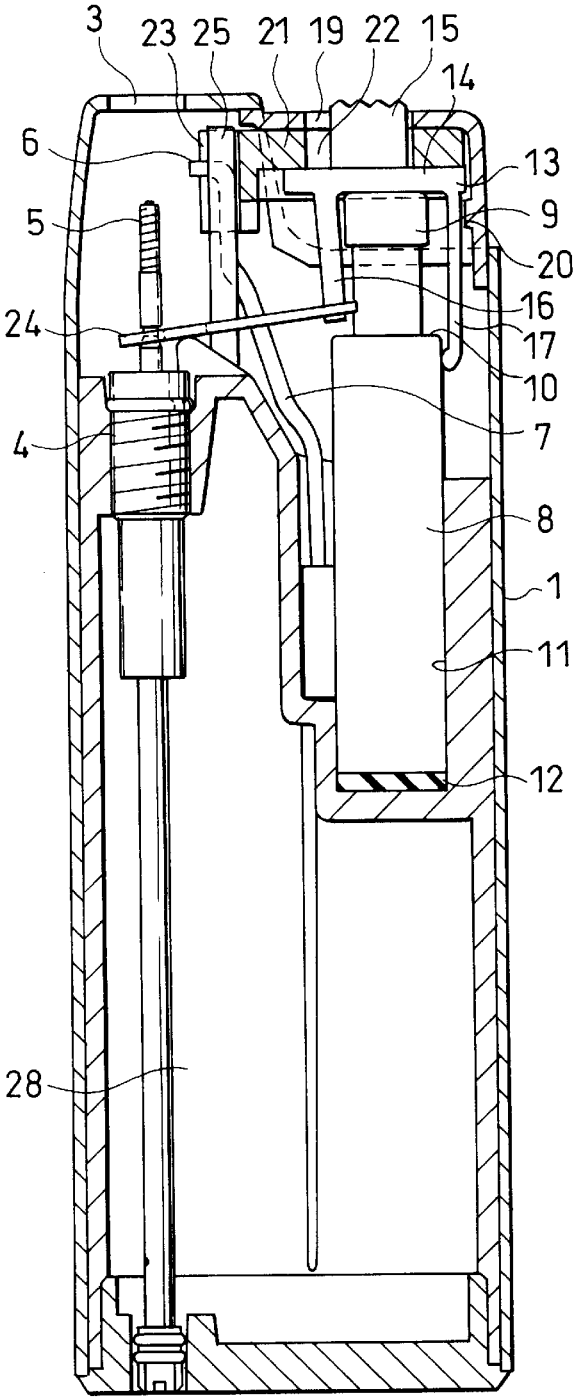
FIG. 2 is a cross-sectional view of the lighter of FIG. 1.
Figure 3:
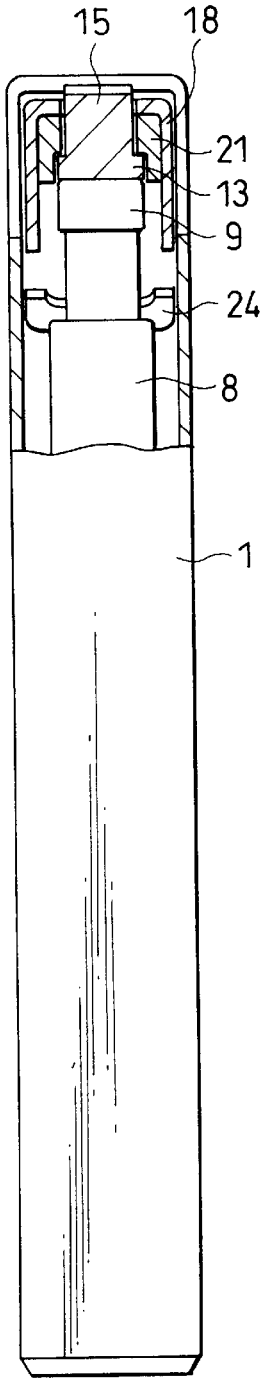
FIG. 3 is a partially cross-sectional rear view of the lighter of FIG. 1.
Figure 4:
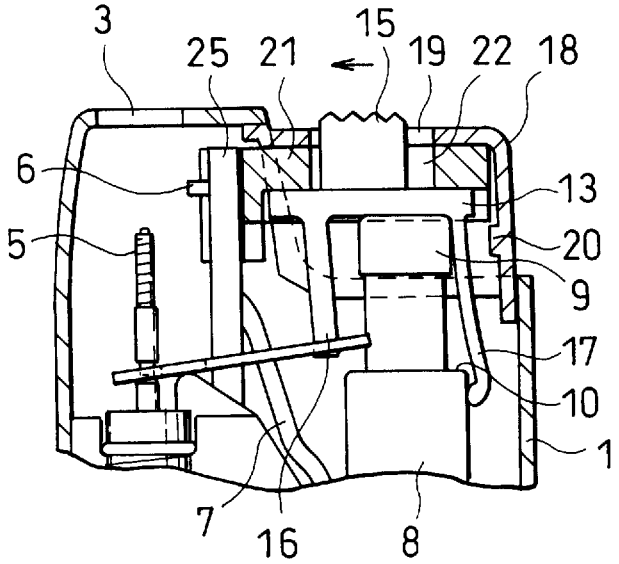
FIG. 4 is a cross-sectional view showing the principal parts of the safety device of the lighter of FIG. 1 in the released state.

FIGS. 1 to 5 illustrate a gas lighter with safety device configured according to a first embodiment of the present invention. With reference to the drawings, numeral 1 denotes a lighter body. The lighter body 1 has an orifice 3 located towards the front of the upper surface of the body 1, and a cutaway portion 2 formed at the rear part of the top surface. The flow of fuel gas from a fuel well 28 is controlled by a fuel valve 4. The fuel valve 4 is located under the orifice 3, and has a nozzle 5. Above and to one side of the nozzle 5 is a discharge electrode 6 extending from a piezoelectric unit 8, at the upper end of a high-voltage line 7. The lower part of the piezoelectric unit 8 is accommodated in a recess 11 formed in the rear part of the lighter body 1. A resilient member 12 allows the piezoelectric unit 8 to be tilted. An ignition button 9 on the top of the piezoelectric unit 8 is smaller than the body of the piezoelectric unit 8, forming a shoulder portion 10. A lock member 13 comprising a baseplate 14, a short, rigid leg 16 extending down from the front edge of the baseplate 14 and a long, resilient leg 17 extending down from the rear edge of the baseplate 14 straddles the top of the ignition button 9 with the end of the resilient leg 17 in contact with the rear wall of the piezoelectric unit 8, whereby the lock member 13 is urged rearward. The end of the short, rigid leg 16 is therefore located above the front shoulder portion of the piezoelectric unit 8. The lock member 13 is formed of a plastic such as polyacetal, and the urging force of the resilient leg 17 is controlled by adjusting the thickness and length of the resilient leg 17.

A cap 18 has an open front shaped to fit the cutaway portion 2 into which the cap 18 can be depressed. A rectangular opening 19 is formed in the top of the cap 18. A grip 15 on the top of the baseplate 14 locates in the opening 19 at the rear end thereof, with the grip 15 protruding from the opening 19. The inside surface of the back wall of the cap 18 has a projection 20. This projection 20 engages with the rear edge of the baseplate 14. This engagement prevents the cap 18 from being dislodged from the cutaway portion 2, even when the cap 18 is subjected to a strong force. The cap 18 is formed of metal or plastic. A carrier 21 having a rectangular opening 22 that is the same shape as that of opening 19 is disposed between the cap 18 and the lock member 13. On the front end of the carrier 21 is a pair of L-shaped guide portions 23 that face each other inwards. These guide portions 23 are vertically slidably engaged with a support post 25 having a T-shaped cross-section disposed between the fuel valve 4 and the piezoelectric unit 8. The carrier 21 is formed of plastic.

With the gas lighter thus configured, even if the cap 18 or grip 15 is subjected to a downward manual force, actuating depression is prevented by the abutment of the end of the rigid leg 16 of the lock member 13 with the shoulder portion 10 of the piezoelectric unit 8, thus rendering the lighter inoperable. To light the lighter, finger pressure is used to slide the grip 15 towards the front of the opening 19, in the direction indicated by the arrow in FIG. 4, against the force of the resilient leg 17. This moves the lock member 13 forwards, shifting the end of the rigid leg 16 into the space adjacent to the piezoelectric unit 8.

Figure 5:
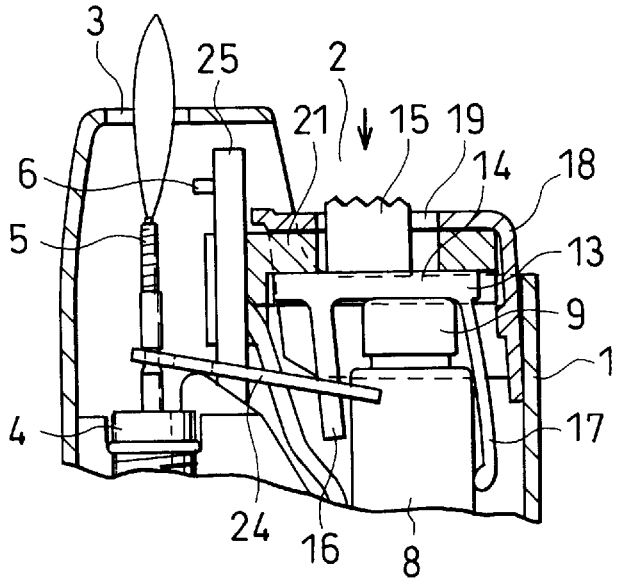
FIG. 5 is a cross-sectional view showing the arrangement of the principal parts of the lighter of FIG. 1 when the flame is ignited.

Operation then continues by pressing the cap 18 and grip 15 down, as indicated by the arrow in FIG. 5. The location of the rigid leg 16 over the space beside the piezoelectric unit 8 enables the cap 18, carrier 21 and lock member 13 to descend as a unit, guided down along the support post 25 by the guide portions 23. As a result, the actuating lever 24 is depressed, which opens the fuel valve 4 and thereby causes fuel gas from the fuel well 28 to issue from the nozzle 5. At the same time the ignition button 9 is depressed by the underside of the lock member baseplate 14 and impacts the piezoelectric unit 8, generating a high voltage that flows to the discharge electrode 6 via the high-voltage line 7, and the jet of fuel gas from the nozzle 5 is ignited by a spark discharge from the electrode 6. Most of the impact to the piezoelectric unit 8 is absorbed by the resilient member 12. When the cap 18 is released, the cap 18, carrier 21 and lock member 13 are moved up by the springback force of the ignition button 9, and the rigid leg 16 is returned to its initial position above the shoulder portion 10 by the force of the resilient leg 17, thereby again preventing depression of the cap 18 and grip 15.

Since the above-described gas lighter safety device utilizes the shoulder portion of the piezoelectric unit 8, it is structurally simple and the locked position is securely maintained. Moreover, the arrangement whereby the lighter can be ignited by pushing the grip 15 forward to release the lock and then depressing the grip 15, gives the operation of this lighter the same feel as that of a conventional lighter.

Figure 6:
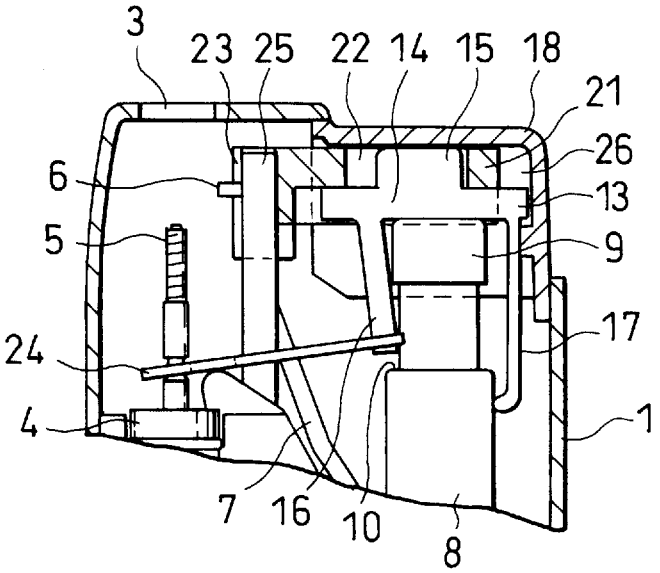
FIG. 6 is a cross-sectional view showing the principal parts of a second embodiment of the gas lighter of the invention.
Figure 7:
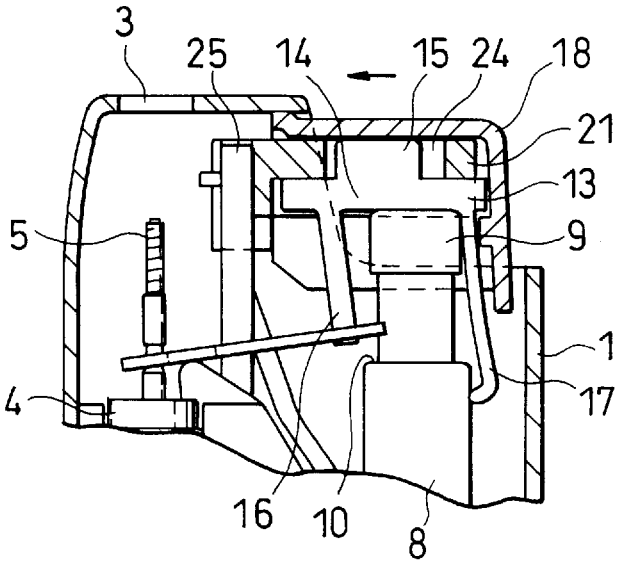
FIG. 7 is a cross-sectional view showing the principal parts of the safety device of the lighter of FIG. 6 in the released state.

FIGS. 6 and 7 illustrate a second embodiment of the gas lighter with safety device. This embodiment has substantially the same structure as that of the first embodiment. What is different is that the height of the grip 15 is substantially the same as the thickness of the carrier 21, and therefore does not protrude from the opening 22. Also, the rear part of the carrier 21 is shorter by an amount corresponding to the sliding distance of the grip 15 in the opening 22, resulting in the formation of a small space 26 in the upper rear interior part of the cap 18. A further difference is that the top surface of the cap 18 is flat and smooth, having no opening. In appearance, this makes this gas lighter indistinguishable from a lighter without a safety device.

As in the first embodiment, in this lighter of this second embodiment the rigid leg 16 is constantly maintained over the shoulder portion 10 of the piezoelectric unit 8 by the urging force of the resilient leg 17 of the lock member 13. Thus, even if the cap 18 is subjected to a downward pressure, the result is to bring the rigid leg 16 into abutment with the shoulder portion 10, rendering the lighter inoperable by preventing actuating depression of the lock member. To light the lighter, finger pressure is used to slide the cap 18 forwards, in the direction indicated by the arrow in FIG. 7. This moves the rear edge of the lock member 13 into abutment against the rear wall of the cap 18, thereby positioning the end of the rigid leg 16 over the space adjacent to the piezoelectric unit 8 and the grip 15 at the front end of the opening 22. However, because of the space 26 between the rear of the carrier 21 and the rear wall of the cap 18, there is no contact between the carrier 21 and the cap 18.

By pushing down with the finger still in the same position on the cap 18, the cap 18, carrier 21 and lock member 13 are moved as one unit down the support post 25, guided by the guide portions 23. As a result, the ignition button 9 is depressed, igniting fuel gas emerging from the nozzle 5. When the cap 18 is released, the cap 18, carrier 21 and lock member 13 are moved back up towards their initial position by the springback force of the ignition button 9, and the rigid leg 16 is returned to its initial position over the shoulder portion 10 by the force of the resilient leg 17, thereby again preventing depression of the cap 18. Thus, while the above-described lighter looks like a conventional lighter, it includes a safety device with a secure action. The urging force of the cap 18 is controlled by the shape and material of the resilient leg 17.

Figure 8:
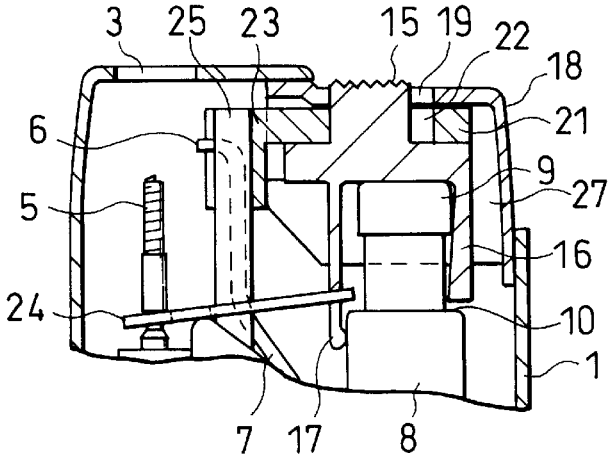
FIG. 8 is a cross-sectional view showing the principal parts of a third embodiment of the gas lighter of the invention.
Figure 9:
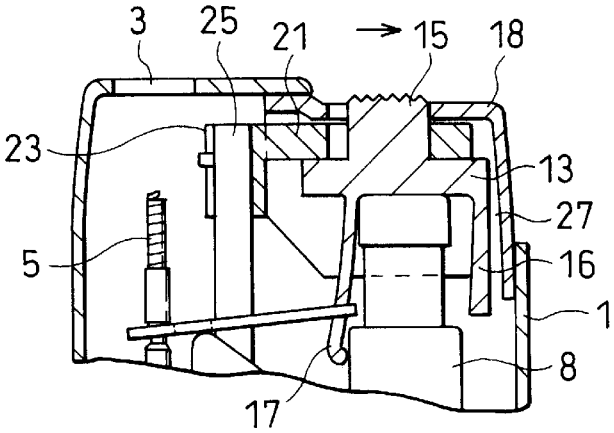
FIG. 9 is a cross-sectional view showing the principal parts of the safety device of the lighter of FIG. 8 in the released state.
Figure 10:
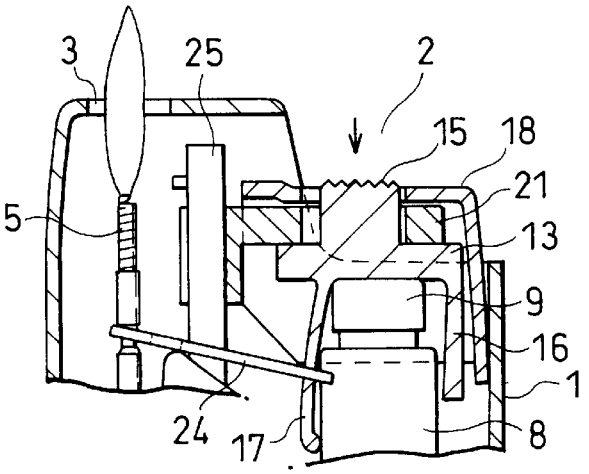
FIG. 10 is a cross-sectional view showing the arrangement of the principal parts of the lighter of FIG. 9 when the flame is ignited.
Figure 11:
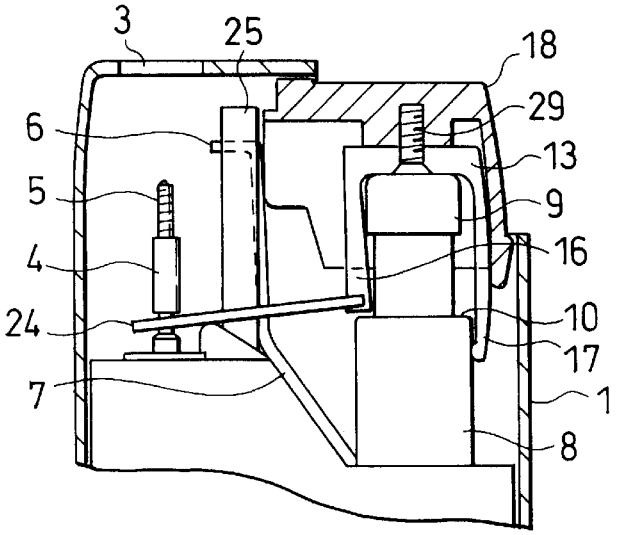
FIG. 11 is a cross-sectional view showing the principal parts of a fourth embodiment of the gas lighter of the invention.

FIGS. 8 to 10 illustrate a third embodiment of the gas lighter with safety device. Where this embodiment differs from the first embodiment is that on the lock member 13, the rigid leg 16 is provided under the rear end of the baseplate 14 and the resilient leg 17 under the front end. As a result, the grip 15 in the openings 22 and 19 of the carrier 21 and cap 18 is constantly urged to the front of the openings by the resilient leg 17. Also, a space 27 that can accommodate the rigid leg 16 is provided between the rear of the baseplate 14 and the back wall of the cap 18.

In the gas lighter thus configured according to this third embodiment, the end of the rigid leg 16 is constantly maintained over the rear shoulder portion 10 of the piezoelectric unit 8, so that even if the cap 18 or grip 15 is subjected to a downward manual force, actuating depression is prevented by the abutment of the end of the rigid leg 16 against the shoulder portion 10, thus preventing the lighter being inadvertently ignited.

To light the lighter, finger pressure is used to slide the protruding grip 15 towards the back of the opening 19, in the direction indicated in FIG. 9 by the arrow, against the force exerted by the resilient leg 17. This moves the rigid leg 16 to the space 27. By pushing down with the finger still in the same position on the cap 18, the cap 18, carrier 21 and lock member 13 are moved as one unit down the support post 25, guided by the guide portions 23. As a result, the ignition button 9 is depressed, igniting the stream of fuel gas emerging from the nozzle 5. When the cap 18 is released, the cap 18, carrier 21 and lock member 13 are moved back up towards their initial position by the springback force of the ignition button 9, and the rigid leg 16 is returned to its initial position over the shoulder portion 10 by the force of the resilient leg 17, thereby again rendering the lighter inoperable by preventing depression of the cap 18 or grip 15.

Figure 12:
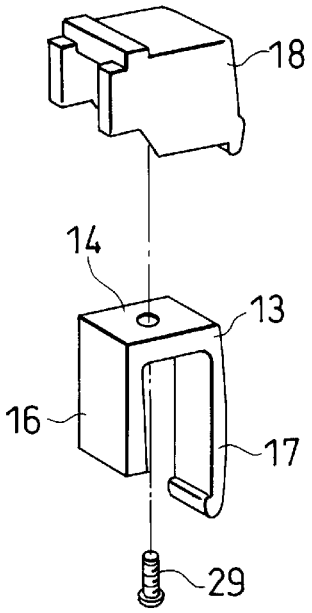
FIG. 12 is a perspective view of the cap and actuating lever of the lighter of FIG. 11.
Figure 13:
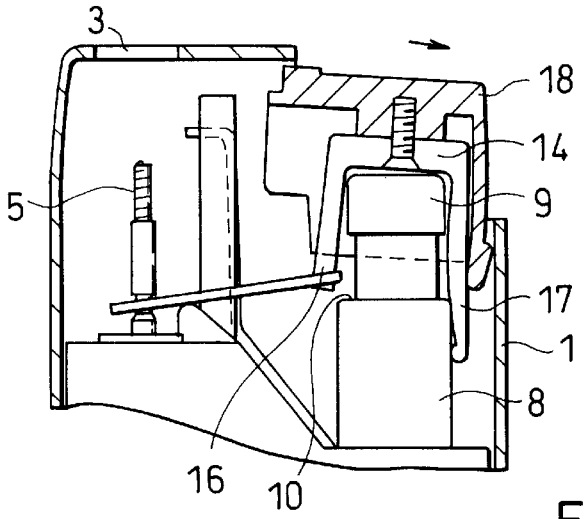
FIG. 13 is a cross-sectional view showing the principal parts of the safety device of the lighter of FIG. 11 in the released state.

FIGS. 11 to 14 illustrate a fourth embodiment of the invention. In this embodiment, as shown in FIG. 12, the safety device is comprised of a cap 18 located in the cutaway portion 2 of the lighter body 1, and a lock member 13 that fits over an ignition button 9 of a piezoelectric unit 8. A screw or the like is used to fasten the cap 18 and lock member 13 together so the rigid leg 16 is at the front and the resilient leg 17 at the rear. Thus, when the lock member 13 is placed over the ignition button 9, as in the first embodiment, the rigid leg 16 is over the front shoulder portion 10 of the piezoelectric unit 8 and the end of the resilient leg 17 is in contact with the rear surface of the piezoelectric unit 8, urging the rigid leg 16 into position over the shoulder portion. Thus, even if the cap 18 is subjected to a depressing force, actuating depression and ignition is prevented by the abutment of the rigid leg 16 against the shoulder portion 10.

Figure 14:
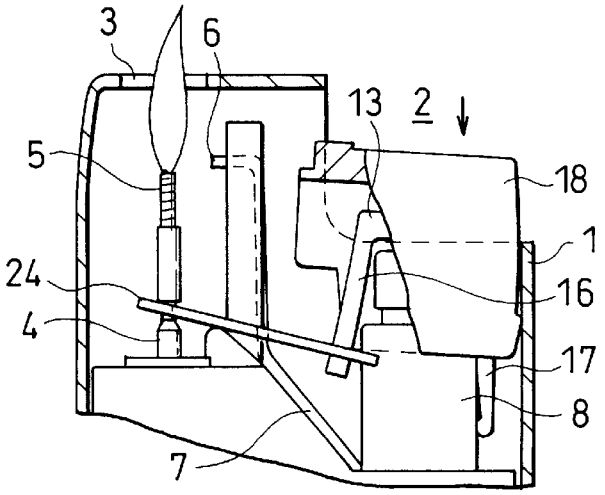
FIG. 14 is a cross-sectional view showing the arrangement of the principal parts of the lighter of FIG. 11 when the flame is ignited.

To light the lighter, a finger is placed on the cap 18 and pressure is exerted as if to tilt the cap 18 towards the rear. This causes the front edge of the baseplate 14 to tilt upwards and the rear edge to tilt downwards, orienting the end of the rigid leg 16 towards the space adjacent to the shoulder portion 10. When the cap 18 is then depressed, as shown in FIG. 14, the rigid leg 16 is flexed outward by the pressure of the contact between the inside surface of the leg 16 and the edge of the shoulder portion 10, the ignition button 9 is depressed and the actuating lever 24 is depressed by the lower edge of the cap 18. This opens the fuel valve 4 and allows fuel gas to be lit at the nozzle 5 by a spark from the discharge electrode 6.

Releasing the cap 18 allows the cap 18 and lock member 13 to be moved back up towards their initial position by the springback force of the ignition button 9, and the rigid leg 16 to be returned to its initial position over the shoulder portion 10 by the force of the resilient leg 17, thereby again rendering the lighter inoperable by preventing depression of the cap 18. The locking effect can be enhanced by providing a plurality of antislip serrations on the top rear part of the cap.

As described in the foregoing, the gas lighter provided with a safety device according to this invention is readily operated by placing a finger on the cap or grip, sliding the cap or grip forwards or backwards and then pressing downward without having to change the hold on the lighter. Unlike conventional gas lighter safety devices which require that the safety lock first be released, after which the user must adjust his or her hold to light the lighter, the lighter of this invention is as easy and convenient to operate as a lighter not equipped with a safety device. Further safety can be ensured by adjusting such factors as the thickness and length of the resilient leg of the lock member to increase the force needed to move the cap or grip to thereby make the lighter child-proof. Furthermore, since it is not necessary to provide a lock member on the outside of the lighter, the lighter looks as good as an ordinary lighter with no safety device, and is even less likely to be operated by mistake or suffer damage.

What is claim is:

1. A gas lighter with a safety device, comprising:

a lighter body that includes a fuel emission portion for emitting fuel from a fuel well, a piezoelectric unit having an ignition pushbutton and a shoulder portion, and a cutaway portion on a top part of the body, a cap on the cutaway portion that can be depressed into the cutaway portion to depress the ignition pushbutton, a lock member located between the cap and ignition pushbutton that straddles the ignition pushbutton, said lock member including a resilient leg at one end and a rigid leg at another end, in which the resilient leg has a larger length than the rigid leg, an end of the resilient leg is in contact with a rear wall of the piezoelectric unit to urge the lock member rearward, and an end of the rigid leg urged into a position over the shoulder portion of the piezoelectric unit by the resilient leg is moved from its position over the shoulder portion to a position away from the piezoelectric unit by operating the lock member against the urging force of the resilient leg.

2. A gas lighter according to claim 1, wherein the lock member has a grip disposed on an upper surface of the lock member and the cap includes a rectangular opening in a top surface of the cap into which the grip is inserted.

3. A gas lighter according to claim 1, wherein the cap fits into the cutaway portion in which the cap can be moved forward.

4. A gas lighter according to claim 1, further comprising a carrier member having guide portions on a front edge of the carrier member, the carrier member being arranged between the cap and the lock member.

* * * * *